US012091780B2

(12) United States Patent
Jung et al.

(10) Patent No.: US 12,091,780 B2
(45) Date of Patent: Sep. 17, 2024

(54) METHOD FOR PRODUCING CARBON FIBER AND CARBON FIBER PRODUCED USING SAME

(71) Applicant: HYOSUNG ADVANCED MATERIALS CORPORATION, Seoul (KR)

(72) Inventors: Hee Rok Jung, Suwon-si (KR); Cheol Kim, Seongnam-si (KR)

(73) Assignee: HYOSUNG ADVANCED MATERIALS CORPORATION, Seoul (KR)

( * ) Notice: Subject to any disclaimer, the term of this patent is extended or adjusted under 35 U.S.C. 154(b) by 259 days.

(21) Appl. No.: 17/638,507

(22) PCT Filed: Aug. 31, 2020

(86) PCT No.: PCT/KR2020/011628

§ 371 (c)(1),
(2) Date: Feb. 25, 2022

(87) PCT Pub. No.: WO2021/045462

PCT Pub. Date: Mar. 11, 2021

(65) Prior Publication Data

US 2022/0205144 A1 Jun. 30, 2022

(30) Foreign Application Priority Data

Sep. 3, 2019 (KR) ..... 10-2019-0108687

(51) Int. Cl.
*D01D 5/06* (2006.01)
*D01F 9/22* (2006.01)
(Continued)

(52) U.S. Cl.
CPC ..... *D01F 9/225* (2013.01); *D01F 11/127* (2013.01); *D06M 13/2246* (2013.01);
(Continued)

(58) Field of Classification Search
CPC ..... D01D 5/06; D01F 9/22; D06M 13/165; D06M 13/17; D06M 13/224;
(Continued)

(56) References Cited

U.S. PATENT DOCUMENTS 5,652,058 A 7/1997 Nagata et al.
2010/0003515 A1* 1/2010 Tanaka ..... D01F 9/22 264/29.2 X

FOREIGN PATENT DOCUMENTS

CN 102277645 B 4/2013
JP H06-166552 A 6/1994
(Continued)

OTHER PUBLICATIONS

Translation of JP 2001172879 A (published on Jun. 26, 2001).*
(Continued)

*Primary Examiner* — Leo B Tentoni
(74) *Attorney, Agent, or Firm* — HSML P.C.

(57) ABSTRACT

The present invention is a method for producing carbon fiber, characterized by using a carbon-fiber precursor produced from a polymer having a narrow molecular weight distribution and by applying only a small amount of a smoothing agent, composed of a specific component, to the carbon fiber surface immediately before winding of carbon fiber. According to the present invention, it is possible to stably produce carbon fiber, which has excellent dispersibility and do not deteriorate in quality and quality even when a sizing agent is not attached to the carbon fiber surface. In addition, the produced carbon fiber is suitable for use in a composite material which is produced by high-temperature processing using a thermoplastic resin.

6 Claims, 1 Drawing Sheet

(51) Int. Cl.

| | |
|---|---|
| ***D01F 11/12*** | (2006.01) |
| ***D06M 13/165*** | (2006.01) |
| ***D06M 13/17*** | (2006.01) |
| ***D06M 13/224*** | (2006.01) |
| *D06M 101/40* | (2006.01) |

(52) U.S. Cl.
CPC ..... *D06M 2101/40* (2013.01); *D10B 2101/12* (2013.01); *D10B 2321/10* (2013.01); *D10B 2401/061* (2013.01); *D10B 2401/063* (2013.01)

(58) Field of Classification Search
CPC ..... D06M 13/2246; D06M 2101/40; D10B 2101/12; D10B 2321/10

USPC ..... 264/29.2, 29.6, 29.7, 182, 178 F, 211.14, 264/211.15, 211.17; 423/447.6, 447.7, 423/447.8; 8/115.6
See application file for complete search history.

(56) References Cited

FOREIGN PATENT DOCUMENTS

| | | | | | |
|---|---|---|---|---|---|
| JP | H11-117179 | A | | 4/1999 | |
| JP | 2001172879 | A | * | 6/2001 | ..... D06M 15/643 |
| JP | 2001-288613 | A | | 10/2001 | |
| JP | 2002-339246 | A | | 11/2002 | |
| JP | 2006-022441 | A | | 1/2006 | |
| JP | 4224989 | B2 | | 2/2009 | |
| JP | 2019099964 | A | * | 6/2019 | ..... D06M 13/17 |
| KR | 10-2013-0029855 | A | | 3/2013 | |
| KR | 10-2019-0058676 | A | | 5/2019 | |
| TW | 201303098 | A1 | | 1/2013 | |

OTHER PUBLICATIONS

Translation of JP 2019099964 A (published on Jun. 24, 2019).*
International Search Report and Written Opinion; International Patent Application No. PCT/KR2020/011628, with English translation of Search Report (11 pages), (dated Dec. 7, 2020).

* cited by examiner

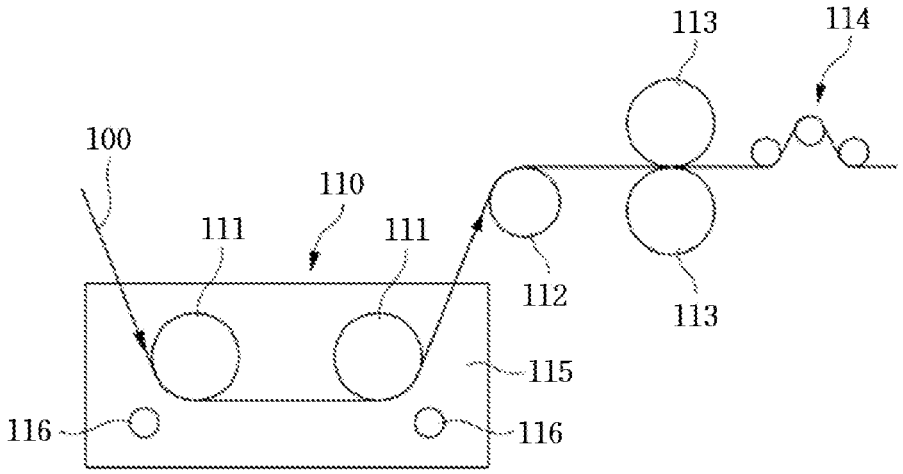
113
114
100
110
111
111
112
113
115
116
116

METHOD FOR PRODUCING CARBON FIBER AND CARBON FIBER PRODUCED USING SAME

TECHNICAL FIELD

The present invention relates generally to a method for producing carbon fiber and carbon fiber produced using the method, and more particularly to a method for producing carbon fiber, which produces precursor fiber using a polymer having low impurity contents and a narrow molecular weight distribution, thereby stably producing carbon fiber that retains good bundle cohesion and have winding and unwinding stability even when a sizing agent composed of a resin component is not applied thereto, and carbon fiber which is produced using the method.

BACKGROUND ART

Carbon fibers produced from a polyacrylonitrile (PAN) polymer have very excellent tensile strength, and thus the PAN polymer is frequently used as a raw material for carbon fiber. More than 90% of all carbon fibers that have recently been produced are PAN-based carbon fibers. In addition, since PAN-based carbon fibers have the potential to be applied to carbon electrode materials for secondary batteries and carbon films, research thereinto and development thereof have been actively conducted.

In order to produce carbon fiber from the PAN polymer, an acrylic fiber obtained by spinning the PAN polymer, i.e., a carbon fiber precursor, is subjected to thermally stabilizing treatment at 200 to 400° C. under an oxidation atmosphere. Fiber produced in this way is referred to as stabilized fiber. The stabilized fiber thus obtained is carbonized at 800 to 2,000° C. under an inert gas atmosphere to produce carbon fiber. In general, carbon fiber is electrochemically surface-treated, washed and dried, and then applied sizing agent including a resin component to minimize friction. For a composite material including a thermosetting resin as a matrix, carbon fiber having applied thereto a sizing agent including the same thermosetting resin, i.e., an epoxy-based resin, is used.

However, a composite material including a thermoplastic resin has a high processing temperature, and thus care must be taken with the sized carbon fiber. It is necessary to select a sizing agent including the same type of sizing component as the thermoplastic resin matrix or having good miscibility, or to use carbon fiber free of a sizing agent including a thermosetting resin component.

If carbon fiber treated with a sizing agent including a conventional thermosetting resin component is used in processes, voids or pores occurs in the thermoplastic composite material due to thermal decomposition of the thermosetting resin in the sizing agent, resulting in deterioration in the mechanical properties of the composite material. Accordingly, it is necessary to use carbon fiber free of a sizing agent including a thermosetting resin component. However, if no sizing agent is applied to a carbon fiber bundle, the carbon fiber bundle has no cohesion, and thus is difficult to wind. In addition, when the fibers on the bobbin are unwound by a user, the fibers are entangled together, or defects such as fiber breakage tend to occur. Such carbon fibers are not bundled, and thus are wound around a roller or a guide during a production process, or adjacent carbon fibers are entangled together during the running of the fibers in the production process, causing fiber breakage or winding or resulting in deterioration in unwinding properties.

In an attempt to overcome these problems, Japanese Patent No. 4224989 discloses carbon fiber having a sizing pick up (SPU) of about 0.4%. According to this patent document, carbon fiber is wound after only water is applied thereto. However, water volatilizes over time, resulting in deterioration in fiber cohesion and the hardness of the fiber on the bobbin and causing unwinding defects due to shrinkage of the bobbin.

DISCLOSURE

Technical Problem

An object of the present invention is to provide a method for producing carbon fiber, which may prevent defects and fiber breakage during unwinding without deteriorating the grade and quality of carbon fiber even when a sizing agent is not attached to the carbon fiber surface and also enables the carbon fiber to be stably wound.

Another object of the present invention is to provide high-quality and high-grade carbon fiber having excellent productivity, which is produced by the above method for producing carbon fiber.

Technical Solution

One aspect of the present invention for achieving the above objects is directed to a method of producing carbon fiber by subjecting a polyacrylonitrile-based carbon-fiber precursor fiber to a thermally stabilizing treatment process, a pre-carbonization process and a carbonization process, the method including: producing carbon-fiber precursor fiber by dry-wet-spinning an acrylonitrile-based polymer having a molecular weight distribution of 1.6 to 1.9; and applying a smoothing agent, which includes at least one selected from the group consisting of an alkyl ether compound having 6 to 35 carbon atoms, an aliphatic ester compound having 6 to 35 carbon atoms, an aromatic ester compound having 6 to 35 carbon atoms, and an ether ester compound having 6 to 35 carbon atoms, to a surface of the carbon-fiber precursor fiber immediately before winding of the carbon fiber, without applying a sizing agent composed of a resin component to the carbon fiber surface.

Another aspect of the present invention for achieving the above objects is directed to carbon fiber produced by the method of producing carbon fiber, the carbon fiber having a hardness of 70 or more and a degree of interlacing ranging from 2.5 to 5.5.

Still another aspect of the present invention for achieving the above objects is directed to a composite material including the carbon fiber and a thermoplastic resin requiring high-temperature processing.

Advantageous Effects

According to the present invention, it is possible to stably produce carbon fiber using carbon-fiber precursor fiber, produced from a polymer having a low impurity content and a narrow molecular weight distribution, without deteriorating the grade and quality of the carbon fiber even when a sizing agent is not attached to the carbon fiber surface, and it is possible to provide a carbon fiber bobbin in a state that is easy to use for high-order processing. Since the carbon fiber according to the present invention has a low impurity content and excellent quality, it is suitable for use in a composite material which is produced by high-temperature processing using un-sized carbon fiber and thermoplastic resin.

DESCRIPTION OF DRAWINGS

FIG. 1 is an overall process chart illustrating a method of applying a smoothing agent to a carbon fiber bundle by a dipping method according to one embodiment of the present invention.

BEST MODE

A method for producing carbon fiber according to the present invention is characterized in that carbon-fiber precursor fiber produced using a polymer having a molecular weight distribution of 1.6 to 1.9 is oxidized, carbonized, washed, dried and passed and then a very small amount of a smoothing agent is applied to the carbon fiber surface immediately before a winding step, so that a sizing agent is not required.

As used herein, the unit "K" refers to the filament number of a carbon fiber tow. 1K means that there are 1,000 single fibers (filaments) in a fiber bundle. For example, 1K refers to a fiber filament count of 1,000, and 10K refers to a fiber filament count of 10,000.

According to the process of producing carbon-fiber precursor fiber according to the present invention, coagulated fiber obtained from dry-wet spinning is washed in a water washing bath and hot-water-drawn in a hot-water bath, and an oiling agent s in an oiling bath is applied to the fiber. After application of the oiling agent, the fiber is dried, and then steam-drawn and heat-set, thereby producing carbon-fiber precursor fiber. The method for producing carbon fiber precursor fiber will be described in greater detail below.

The acrylonitrile-based polymer that is used in the present invention may, if necessary, further contain, as one or more copolymerizable components (minor components other than acrylonitrile) known in the art, a component for promoting compaction in the spinning process, a unit including a component for promoting drawing, a unit including a component for promoting thermally stabilizing treatment in the thermally stabilizing treatment process, and a unit including a component for promoting oxygen permeation. The content of these copolymerizable components is preferably less than 10 wt %, more preferably less than 5 wt %, for example, 1 to 5 wt %, based on the total weight of the acrylonitrile polymer.

These minor components and the main component are added to an organic solvent in an amount of 15 to 25 wt %. In this case, an initiator is added in an amount of 0.1 to 1 wt % based on the weight of monomers (main component and minor components), and a molecular weight adjusting agent is added in an amount of 0.1 to 1 wt %. In this state, polymerization may be performed at 60 to 70° C. for 10 hours or more to obtain an acrylonitrile-based copolymer dissolved in the organic solvent. The obtained copolymer is a spinning solution containing a PAN polymer.

The acrylonitrile-based polymer that is used in the present invention has a low impurity content and a narrow molecular weight distribution (poly-distribution (PD)) (PD=Mw (weight-average molecular weight, g/mol)/Mn (number–average molecular weight, g/mol)) of 1.6 to 1.9, and thus the produced precursor fiber has excellent physical properties and has excellent quality due to the low impurity content thereof.

If the molecular weight distribution of the polymer is less than 1.6 or more than 1.9, the polymer may have poor drawability in the spinning process, and thus the orientation of the fiber molecular structure may become poor, resulting in problems associated with precursor single filament breakage or bundle breakage and causing deterioration in the physical properties of the precursor fiber. If this precursor fiber is carbonized, the non-uniformity of carbon fiber may be further increased, and serious process problems may occur, such as single filament breakage, fiber curling and bundle breakage.

The spinning solution containing the PAN polymer is moved to and degassed in a degassing bath as needed, and then spun. Dry-wet spinning can be used as a spinning method, and for example, it may be performed as follows. The PAN polymer produced to have an intrinsic viscosity of 1.4 to 1.8 is dissolved in dimethylsulfoxide (DMSO) at a concentration of 18 to 22 wt % to make a spinning solution. Then, the spinning solution is passed through a spinning nozzle and discharged into a coagulation bath containing 30 to 60 wt % of DMSO.

The coagulated fiber that passed through the coagulation bath is washed by passage through a water washing bath. In addition, a vibrating roller and a squeezing roller may be used to effectively wash out the solvent inside the spun coagulated fiber. The frequency of the vibrating roller is 20 to 100 Hz and is in the form of a pre-roller, and the pressure of the squeezing roller is generally 1 to 5 kgf/cm$^2$, preferably 2 to 3 kgf/cm$^2$. After the completion of the process of washing, drawing and drying the coagulated fiber, an oiling agent in an oiling bath is applied to the dried fiber. Specifically, the dried fiber is treated with a 0.01 to 5.0 wt % aqueous solution of an oiling agent containing an amino-modified silicone oil, fine particles and an ammonium compound. Then, if necessary, the treated fiber may be drawn again in a high-temperature medium such as steam, thereby producing carbon-fiber precursor fiber. The total draw ratio of the produced carbon-fiber precursor fiber may generally be 7 to 35, and the single fiber fineness thereof may be 0.5 to 2.0 dtex.

The spun carbon fiber precursor may be subjected to thermally stabilizing treatment at 200 to 400° C. under an oxygen atmosphere according to a conventional method, and carbonized at 800 to 2000° C. under an inert gas atmosphere, thereby producing carbonized fiber having uniform physical properties. To improve the adhesion of the produced carbonized fiber to a matrix resin in a composite material, the produced carbonized fiber is surface-treated electrochemically, washed with water, and dried.

The washed fiber is dried to a water content of 1% or less, preferably 0.4% or less, and a smoothing agent diluted in a solvent at a concentration of 0.1 to 2 wt % is applied to the carbon fiber surface. In this case, if the concentration of the smoothing agent in the solvent is less than 0.1 wt %, the effect of applying the smoothing agent may be insufficient. In contrast, if the concentration is more than 2 wt %, a problem may arise in that voids occur due to rapid volatilization of the smoothing agent component during high-temperature processing in the production of a composite material, resulting in deterioration in the performance of the composite material.

FIG. 1 is an overall process chart illustrating a method of applying a smoothing agent to a carbon fiber bundle according to one embodiment of the present invention.

As shown in FIG. 1, in order to apply a smoothing agent to a carbon fiber bundle 100 according to one embodiment of the present invention, the carbon fiber bundle 100 is first passed through a smoothing agent dipping roll 111 in an impregnation tank 110 containing a smoothing agent 115 (step a). Smoothing agent circulating rolls 116 provided in the impregnation tank 110 evenly circulate the smoothing agent.

As the smoothing agent 115, it is possible to use one or more selected from the group consisting of an alkyl ether compound, an aliphatic ester compound, an aromatic ester compound, a polyether ester compound and a mineral oil, which each have 5 to 35 carbon atoms.

Examples of the aliphatic ester compound include ester compounds obtained by esterification of aliphatic monocarboxylic acids with aliphatic monohydric alcohols, ester compounds obtained by esterification of aliphatic monocarboxylic acids with aliphatic polyhydric alcohols, and ester compounds obtained by esterification of aliphatic polyhydric carboxylic acids with aliphatic monohydric alcohols. Examples of the aliphatic monohydric alcohols include butyl stearate, octyl stearate, oleyl laurate, and oleyl oleate, and examples of the aliphatic polyhydric alcohols include 1,6-hexanediol didecanoate.

Among them, the aliphatic ester compound having 6 to 35 carbon atoms is preferably used, and an aliphatic ester compound having 5 to 35 carbon atoms, obtained by esterification of aliphatic monocarboxylic acid with aliphatic monohydric alcohol, is more preferably used.

Examples of the aromatic ester compound include ester compounds obtained by esterification of aliphatic monocarboxylic acids with aromatic alcohols or esterification of aromatic monocarboxylic acids with aliphatic monohydric alcohols. Preferably, an ester compound obtained by esterification of aromatic carboxylic acid with aliphatic monohydric alcohol is used.

Examples of the polyether ester compound include polyether compounds which are alkylene oxide adducts of aliphatic alcohols, polyether compounds which are alkylene oxide adducts of aromatic alcohols, and polyether ester compounds obtained by esterification of aromatic carboxylic acids. As the alkyl ether compound, it is possible to use diisopropyl ether, cyclohexyl ether, aryl ether, or the like.

As solvents for diluting the smoothing agent of the present invention, it is possible to use conventional organic solvents, such as dimethylsulfoxide (DMSO) or mineral oil, and water, which are capable of dissolving the smoothing agent. The smoothing agent is diluted in the solvent at a concentration of 0.05 to 0.5 wt %.

In the present invention, the process of applying the smoothing agent to the carbon fiber surface may be performed by a spray, kissing roll, dipping or coating method.

Then, in order to remove an excessive portion of the smoothing agent applied to the carbon fiber bundle 100 in step (a), the carbon fiber bundle is passed through nip rollers 113 via a guide roll 112 (step (b)). The nip rollers 113 are composed of a pair of two rollers facing each other, and the pressing force between the rollers may be adjusted by hydraulic pressure. Therefore, an excessive portion of the smoothing agent 115 is removed by pressing the carbon fiber bundle 100. The pressure of the nip rollers 113 is preferably 0.5 to 5 $kg/cm^2$. If the pressure of the nip rollers 113 is less than 0.5 $kg/cm^2$, the effect of removing an excessive portion of the smoothing agent may be insufficient. In contrast, if the pressure is more than 5 $kg/cm^2$, a problem may arise in that the amount of smoothing agent applied is decreased and the carbon fiber is broken.

After step (b), the carbon fiber bundle is passed through embossing rolls 114 to widen the fiber width (step (c)). Step (c) is performed to widen the fiber width that tends to be narrowed by the surface tension of the smoothing agent after applying the smoothing agent to the surface of the carbon fiber bundle 100. On the surface of the embossing roll 114, a plurality of protrusions (not shown) protruding in a semi-circular shape in a circumferential direction while protruding along the longitudinal direction of the embossing roll 114 are formed at a predetermined distance from one another. These protrusions act to keep the tension of the fiber constant and to widen the fiber width.

Finally, the carbon fiber bundle having the smoothing agent applied to the surface thereof is dried by passage through a hot-air dryer or a heating roller (not shown) (step (d)). The drying may be performed using a heating roller method, a hot-air drying method, or a combination of the two methods. The drying temperature is preferably 130 to 230° C., more preferably 150 to 190° C. The drying treatment time changes depending on the heat-treatment temperature, but is preferably 10 sec to 15 min, more preferably 30 sec to 5 min. If the drying temperature is lower than 130° C. or the drying treatment time is shorter than 10 sec, a problem may arise in that sufficient drying does not occur. In contrast, if the drying temperature is higher than 230° C. or the drying treatment time is longer than 15 min, a problem may arise in that the smoothing agent volatilizes completely, and thus does not provide cohesion. As described above, a predetermined amount of the smoothing agent is applied to the carbon fiber bundle. In the present invention, the amount of smoothing agent applied to the carbon fiber is preferably 0.1 to 1.0 wt %, more preferably 0.05 to 0.25 wt %, based on the total weight of the carbon fiber.

If the amount of smoothing agent applied to the carbon fiber is less than 0.1 wt %, the effect of applying the smoothing agent may be insufficient. In contrast, if the amount of smoothing agent is more than 1.0 wt %, fume or voids may be generated by the processing temperature during composite material production due to the excessive amount of the smoothing agent.

The carbon fiber produced as described above is characterized in that, even though a sizing agent including a resin component is not applied to the carbon fiber surface, the carbon fiber is wound while having cohesion as a result of applying the smoothing agent thereto immediately before winding of the carbon fiber in order to impart cohesion and smoothing properties. Accordingly, no fuzz is generated in the carbon fiber, and thus the carbon fiber has excellent processability into a composite material, and has excellent quality and grade by exhibiting sufficient tensile strength. In general, for an intermediate material and composite material including a thermoplastic resin as a matrix resin, a very high processing temperature is used, and thus, when a conventional sizing agent including an epoxy component is present, the performance of the composite material deteriorates due to thermal decomposition of the sizing agent at high temperature. In addition, when carbon fiber having a conventional epoxy sizing agent applied thereto is used for metal plating of the carbon fiber, the process is complex and complicated because metal plating is performed after removal of the sizing agent. According to the present invention, a sizing agent is not used and thus there is no need to perform the desizing process, so that the process is simple and effective plating is possible.

In the present invention, electrolytic plating or electroless plating may be used for metal plating of the carbon fiber surface. In general, since an epoxy sizing agent remains on the carbon fiber surface, the sizing agent is dissolved and washed out by immersion in an organic solvent such as methyl ethyl ketone, or in an acid aqueous solution such as a hydrochloric acid aqueous solution or a sulfuric acid aqueous solution.

For electrolytic plating, the carbon fiber is brought into contact with a cathode under a certain tension and introduced into a metal plating bath, and metal plating of the carbon fiber is performed while maintaining a certain distance from the anode located in the plating bath. In this case, a current is applied between the anode and the cathode to form a metal plating layer on the carbon fiber. It is preferable to use a metal plate to be coated as the anode and a graphite rod as the cathode. When the graphite rod is used as the cathode, it is possible to prevent the electrode from being corroded when exposed to the metal plating bath for a long time.

Meanwhile, for electroless plating, the sizing agent is removed, and then the carbon fiber is immersed in a bath containing a colloidal solution composed of the metal to be coated and a reducing agent under a certain tension.

The carbon fiber according to the present invention is not limited to standard modulus carbon fiber, and may be applied to both medium-modulus carbon fiber and high-modulus carbon fiber. For example, standard modulus high strength type (5.0 GPa or more), medium-modulus (280 GPa or more) and high-modulus (320 GPa or more) carbon fibers may all be used, and the bundle filament count may be selected within a range of 3K (3,000 filaments) to 48K. In addition, the hardness of the carbon fiber is 70 or more, and the degree of interlacing thereof (degree of interlacing=1000 mm/free fall distance (mm)) ranges from 2.5 to 5.5.

The carbon fiber produced as described above may be used as a resin and widely used as a reinforced composite material. As used herein, the term "composite material" refers collectively to plastic matrix composites (PMCs) such as fiber reinforced plastics (FRPs).

Meanwhile, metal-coated carbon fiber may be produced by coating with a metal. In addition, it is possible to produce a composite material including the produced metal-coated carbon fiber and a thermoplastic resin. This composite material preferably has a structure in which the carbon fiber and the thermoplastic resin form the respective layers and are stacked on each other.

Hereinafter, the present invention will be described with reference to specific examples. These examples are merely to illustrate the present invention in detail and are not intended to the scope of the present invention.

Example 1

Production of Carbon Fiber

An acrylonitrile-based polymer having a molecular weight distribution of 1.6 to 1.8 was prepared by solution polymerization of 99 wt % of acrylonitrile, 1.0 wt % of the copolymerizable monomer itaconic acid and 20 wt % of an acrylic comonomer in dimethyl sulfoxide. After polymerization, a spinning solution obtained by neutralizing the itaconic acid until the pH of the polymer reaches 8.0 to 8.5 was dry-wet-spun in a coagulation bath consisting of a 32.5 wt % dimethylsulfoxide (DMSO) aqueous solution at 10° C. using two nozzles, each having 6,000 holes and a hole diameter of 0.12 mm, and the resulting coagulated fiber was washed with water, and then drawn in hot water. After an amino-modified silicone-based oil was applied to the drawn carbon fiber, the carbon fiber was passed through a roll dryer heated to 150° C., and then steam-drawn at a draw ratio of 6. Through this process, 1.0-denier precursor fiber was produced. The precursor fiber was subjected to thermally stabilizing treatment in air at a temperature of 225 to 260° C. while it was drawn at a draw ratio of 1.0, thereby obtaining stabilized fiber having a specific gravity of 1.350. The obtained stabilized fiber was pre-carbonized at a temperature of 300 to 700° C. under a nitrogen atmosphere while it was drawn at a draw ratio of 1.15. The obtained pre-carbonized fiber was carbonized at a maximum temperature of 1,300° C. under a nitrogen atmosphere to obtain 800-tex carbonized fiber. The obtained carbonized fiber was surface-treated electrochemically, washed with water, and dried. The fiber was dried to a water content of 0.1% or less, and a smoothing agent composed of an alkyl-based mineral oil having 20 to 40 carbon atoms was diluted at a concentration of 0.5 wt % and sprayed onto the fiber surface 5 mm above the fiber surface. Then, the fiber was dried at 150° C. to 190° C. by passage through a heating roller and then wound.

Example 2

Carbonized fiber was produced in the same manner as in Example 1. The carbonized fiber was dried to a water content of 0.1% or less, and a smoothing agent composed of an alkyl-based mineral oil having 20 to 40 carbon atoms was diluted at a concentration of 0.5 wt % in an alkyl-based mineral oil having 10 to 16 carbon atoms. Then, kissing rolls were located on both sides of the carbon fiber, and the smoothing agent component was applied to the carbon fiber surface while the rolls were rotated at a speed of 100 to 900 rpm. The fiber having the smoothing agent applied thereto was dried at 150° C. to 190° C. by passage through a heating roller and wound.

Example 3

Carbonized fiber was produced in the same manner as in Example 1. The carbonized fiber was dried to a water content of 0.1% or less, and a smoothing agent composed of an alkyl-based mineral oil having 20 to 40 carbon atoms was diluted at a concentration of 0.5 wt % in water and then added into a bath. Then, the smoothing agent component was applied to the carbon fiber by dipping the carbon fiber in the bath. The fiber having the smoothing agent applied thereto was dried at 150 to 190° C. by passage through a heating roller and wound.

Examples 4 to 6

Carbon fibers were produced in the same manner as in Example 1, except that the concentration of the smoothing agent and the method of applying the smoothing agent were changed. The method of applying the smoothing agent and the amount of the smoothing agent attached to the carbon fiber are shown in Table 1 below.

Example 7

Carbon fiber was produced in the same manner as in Example 1, except that an aliphatic ester compound having 5 to 35 carbon atoms, obtained by esterification of aliphatic monocarboxylic acid with aliphatic monohydric alcohol, was dissolved in water at a concentration of 0.05 wt % and used as the smoothing agent and a spray method was performed.

Example 8

Carbon fiber was produced in the same manner as in Example 1, except that the same smoothing agent as used in Example 1 was diluted at the same concentration in an alkyl-based mineral oil having 10 to 16 carbon atoms and a kissing roll method was used.

Example 9

Carbon fiber was produced in the same manner as in Example 1, except that an aliphatic ester compound having 5 to 35 carbon atoms, obtained by esterification of aliphatic monocarboxylic acid with aliphatic monohydric alcohol, was dissolved in water at a concentration of 0.05 wt % and used as the smoothing agent and a dipping method was performed.

Comparative Example 1

Production of Carbon Fiber>

Carbonized fiber was produced in the same manner as in Example 1, except that a polymer having a molecular weight distribution of 1.3 to 1.8 was used. The fiber was surface-treated, washed with water, and dried to a water content of 0.1% or less without applying a sizing agent thereto. The dried fiber was passed through a heating roll, and then wound.

Comparative Example 2

Production of Carbon Fiber>

Carbonized fiber was produced in the same manner as in Example 1, except that a polymer having a molecular weight distribution of 1.7 to 2.2 was used. The fiber was surface-treated, washed with water, and dried to a water content of 2% or less without applying a sizing agent thereto. The dried fiber was passed through a heating roll, and then wound.

<Measurement of Physical Properties of Strands of Carbon Fiber Bundle>

The carbon fiber bundles produced in the Examples and the Comparative Examples were unwound. For evaluation of the tensile properties of the carbon fibers, the strength of the impregnated and cured carbon fiber strands in the epoxy resin was measured in accordance with ISO 10618.

After 10 strands of the carbon fiber bundle were measured, the average values excluding the minimum and maximum values were taken as the strand tensile strength and the strand tensile modulus.

<Measurement of Rate of Smoothing Agent Attached to Carbon Fiber>

After winding, each carbon fiber was unwound and cut to a length of 2 m, and the weight ($W_1$) thereof was measured. The cut fiber was placed in a 1-L bottle containing 500 ml of acetone. After 20 minutes of ultrasonic treatment, the fiber was dried in a hot-air dryer at 115° C. for 30 minutes, and cooled by standing in a desiccator for 20 minutes, and then weight ($W_2$) thereof was measured. Five measurements per sample were made and averaged.

$$\text{Amount of sizing agent and smoothing agent attached}=(W_1-W_2)/W_1-100(\text{wt }\%)$$

<Measurement of Width Before Spreading and Width After Spreading of Fiber Bundle>

The carbon fiber bobbin was mounted on a rewinder, and the fiber was unwound at a speed of 3 m/min, passed through pin guides, and wound on a winder. The bundle width W1 at the time of passing through the first pin guide is referred to as the width before spreading, and the fiber was passed through the pin positioned in a W shape. The bundle width W2 at the fifth pin guide is referred to as the width after spreading. The pin guide diameter was 10 mm, and 5 pin guides were placed at 120 degree intervals. When the fiber bundle was passed through the first and fifth pin guides, the fiber width was measured by a laser beam fiber width sensor mounted. The average value and CV % were calculated from the wound fiber width and opened fiber width of carbon fiber measured by the laser yarn width sensor for 30 minutes.

<Fuzz Caused by Carbon Fiber Friction>

During measurement of the opened fiber width of the carbon fiber, a 1-m fiber sample was taken from the fiber that passed through the five pin guides. The broken single filament or fuzz in the fiber sample was sensory-evaluated and graded as bad, good, and excellent.

<Measurement of the Hardness of Carbon Fiber Bundle Package>

In order to evaluate the winding stability of the carbon fiber, the carbon fiber bundle was wound and then the hardness thereof was evaluated. When a load is applied vertically to the sample to be measured using a durometer, the degree of rebound of the needle at the bottom of the durometer is displayed on the scale as a hardness value. The higher the value, the harder the specimen and the higher the winding stability.

The hardness value is expressed by the following formula, and the unit thereof is dimensionless:

$$H_s=k_h/h_0$$

wherein:

$H_s$: shore hardness value k: proportional constant $h_o$: drop height h: rebound height A carbon fiber bundle package obtained by winding 4 kg of the carbon fiber was used as the sample, and the hardness of the sample was measured in according to JISK 7312 using an Asker durometer (Asker C type) as a shore durometer.

TABLE 1

Mechanical properties and evaluation results of standard-modulus 12K bundle carbon fibers

| | Type of smoothing agent | Method of applying smoothing agent | Amount (%) of attached smoothing agent | Hardness of carbon fiber | Tensile Strength of carbon fiber (GPa) | Tensile Modulus of carbon fiber (GPa) | Fuzz caused by carbon fiber (CF) friction | Bundle width before spreading (mm)(W1) | Bundle width after spreading (mm)(W2) |
|---|---|---|---|---|---|---|---|---|---|
| Example 1 | alkyl- | spray | 0.1 | 70 | 5.2 | 245 | good | 3.9 | 10.2 |
| Example 2 | based | kissing roll | | 73 | 5.1 | 245 | bad | 3.5 | 10.5 |
| Example 3 | | dipping | | 73 | 5.2 | 245 | good | 4.1 | 11.0 |
| Example 4 | alkyl- | spray | 0.05 | 74 | 5.4 | 245 | bad | 5.2 | 10.7 |
| Example 5 | based | kissing roll | 0.05 | 74 | 5.4 | 245 | good | 4.9 | 10.8 |
| Example 6 | | dipping | 0.05 | 76 | 5.6 | 245 | excellent | 5.5 | 12.0 |

TABLE 1-continued

Mechanical properties and evaluation results of standard-modulus 12K bundle carbon fibers

| | Type of smoothing agent | Method of applying smoothing agent | Amount (%) of attached smoothing agent | Hardness of carbon fiber | Tensile Strength of carbon fiber (GPa) | Tensile Modulus of carbon fiber (GPa) | Fuzz caused by carbon fiber (CF) friction | Bundle width before spreading (mm)(W1) | Bundle width after spreading (mm)(W2) |
|---|---|---|---|---|---|---|---|---|---|
| Example 7 | alkyl | spray | 0.05 | 72 | 5.4 | 245 | good | 5.0 | 12.6 |
| Example 8 | ester- | kissing roll | 0.05 | 74 | 5.4 | 245 | excellent | 4.7 | 12.3 |
| Example 9 | based | dipping | 0.05 | 78 | 5.5 | 245 | excellent | 4.8 | 12.5 |
| Comparative Example 1 | -(water) | dipping | 0.4% water content | 62 | 5.0 | 245 | bad | 6.6 | 14.2 |
| Comparative Example 2 | -(water) | dipping | 0.8% water content | 65 | 4.9 | 245 | bad | 6.0 | 13.0 |

Referring to Table 1 above, it was confirmed that the carbon fiber according to the embodiment of the present invention did not show problems of fiber breakage or fuzz occurrence during the production process even when a sizing agent including a resin component was not applied thereto, and thus the productivity of the carbon fiber was not reduced. In addition, it was confirmed that carbon fiber exhibited excellent physical properties. The hardness and quality characteristics of the carbon fiber did differ depending on the type or amount of the smoothing agent and the method of applying the smoothing agent. When the dipping method was used to apply the smoothing agent, the occurrence of fuzz by carbon fiber friction decreased due to uniform application of the smoothing agent, and the winding stability of the carbon fiber was high because the smoothing agent was dispersed evenly on the carbon fiber surface. In addition, even when the dipping method was used, there was a difference between application of the smoothing agent and application of water alone without the smoothing agent and between application of the alkyl-based mineral oil and the alkyl ester-based compound. When only water was applied alone without the smoothing agent, many defects were caused by friction, resulting in deterioration in the physical properties of the carbon fiber. In contrast, when the smoothing agent was applied, there was no deterioration in the physical properties. In addition, when the smoothing agent was applied, cohesion was created and the hardness of carbon fiber increased by about 10.

It could be confirmed that when only water was applied alone, a problem arose in that the water content changed over time, causing problems such as hardness of carbon fiber and shrinkage, and it could also be confirmed that when the smoothing agent was applied for winding, the fiber had cohesion during winding, exhibited an excellent unwinding properties without fiber curling or fiber breakage during unwinding, and had an excellent opening property due to the absence of a resin component.

Although the specific embodiments of the present invention have been described in detail above, it will be obvious to those skilled in the art that the present invention is not limited to the above-described embodiments and various alterations and modifications in the configuration of the present invention may be made without departing from the spirit or scope of the present invention. Therefore, the scope of protection of the present invention should be determined by the appended claims and the scope equivalent thereto.

DESCRIPTION OF REFERENCE NUMERALS

100: carbon fiber bundle
110: impregnation bath
111: smoothing agent dipping roll
112: guide roll
113: nip roller
114: embossing roll
115: smoothing agent
116: smoothing agent circulating roll

The invention claimed is:

1. A method of producing a carbon fiber, comprising:

dry-wet-spinning an acrylonitrile-based polymer having a molecular weight distribution of 1.6 to 1.9 so as to obtain a polyacrylonitrile-based carbon-fiber precursor fiber;

subjecting the polyacrylonitrile-based carbon-fiber precursor fiber to a thermally stabilizing treatment process, a pre-carbonization process and a carbonization process so as to obtain a carbon fiber, and applying only a smoothing agent to a surface of the carbon fiber after the carbonization process and immediately before winding of the carbon fiber, without applying a sizing agent composed of a resin component to the surface of the carbon fiber, wherein the smoothing agent is at least one selected from the group consisting of an alkyl ether compound having 6 to 35 carbon atoms, an aliphatic ester compound having 6 to 35 carbon atoms, an aromatic ester compound having 6 to 35 carbon atoms, and an ether ester compound having 6 to 35 carbon atoms.

2. The method of claim 1, wherein the smoothing agent is diluted in an organic solvent or water at a concentration of 0.1 to 1.0 wt % based on the weight of the solvent.

3. The method of claim 1, wherein applying the smoothing agent to the carbon fiber surface is performed by any one of a spray method, a kissing roll method, a dipping method, and a coating method.

4. The method of claim 1, further comprising drying a carbon fiber bundle, which comprises the smoothing agent applied to the surface of the carbon fiber, by passage through a hot-air dryer or a heating roller.

5. The method of claim 4, wherein the drying is performed at a temperature of 130 to 230° C. for 10 seconds to 15 minutes.

6. The method of claim 1, wherein an amount of smoothing agent attached to the carbon fiber is 0.05 to 0.1 wt % based on the total weight of the carbon fiber.

* * * * *